United States Patent [19]

Miyakawa et al.

[11] 4,414,322

[45] Nov. 8, 1983

[54] TWO-COMPONENT TYPE MAGNETIC DEVELOPER

[75] Inventors: Nobuhiro Miyakawa; Masanori Fujii, both of Suita; Kouzi Maekawa, Kyoto, all of Japan

[73] Assignee: Mita Industrial Co. Ltd., Osaka, Japan

[21] Appl. No.: 341,820

[22] Filed: Jan. 22, 1982

[30] Foreign Application Priority Data

Jan. 26, 1981 [JP] Japan ..... 56-8959

[51] Int. Cl.[3] ..... G03G 9/14

[52] U.S. Cl. ..... 430/106.6; 430/108; 430/109

[58] Field of Search ..... 430/106.6, 109, 122, 430/108

[56] References Cited

U.S. PATENT DOCUMENTS 3,520,811 7/1970 Swoboda .

4,142,981 3/1979 Bean et al. ..... 430/111 X 4,165,393 8/1979 Suzuki et al. ..... 430/122

FOREIGN PATENT DOCUMENTS 55-28020 2/1980 Japan ..... 430/106.6

2074745 11/1981 United Kingdom ..... 430/106.6

*Primary Examiner*—Roland E. Martin, Jr.

*Attorney, Agent, or Firm*—Sherman & Shalloway

[57] ABSTRACT

Disclosed is a two-component type magnetic developer comprising a magnetic carrier consisting of a non-pulverizing agglomerate of cubic particles of magnetite having a particle size of 1 to 14 microns as measured by an electron microscope and a magnetic toner having a high electric resistance and consisting of particles having a particle size of 3 to 30 microns and comprising a binder resin medium and magnetite having a particle size smaller than 1 micron, which is dispersed in the binder resin medium, the magnetic carrier/magnetic toner mixing weight ratio being in the range of from 5/100 to 40/100.

4 Claims, 3 Drawing Figures

TWO-COMPONENT TYPE MAGNETIC DEVELOPER

BACKGROUND OF THE INVENTION (1) Field of the Invention

The present invention relates to a two-component type magnetic developer for use in the electrophotographic process. More particularly, the present invention relates to a novel two-component type magnetic developer comprising magnetic toner particles having a high electric resistance and a non-pulverizing agglomerate of magnetic particles as a magnetic carrier.

(2) Description of the Prior Art

As the developer capable of developing an electrostatic latent image without using a particular carrier, there is known a so-called one-component type magnetic developer comprising a powder of a magnetic material contained in developer particles.

As one type of this one-component magnetic developer, there is known a so-called conductive magnetic developer in which a fine powder of a magnetic material is incorporated in developer particles to impart a property of being magnetically attracted and a conducting agent such as carbon black is distributed on the surfaces of the particles to impart them electrically conductive (see, for example, the specifications of U.S. Pat. No. 3,639,245 and U.S. Pat. No. 3,965,022). When this conductive magnetic developer is brought in the form of a so-called magnetic brush into contact with an electrostatic latent image-carrying substrate to effect development of the latent image, there can be obtained an excellent visible image free of a so-called edge effect or fog. However, as is well known, when the developer image is transferred to an ordinary transfer sheet from the substrate, a serious problem arises. More specifically, as described in Japanese Patent Application Laid-Open Specification No. 117435/75, when the inherent electric resistance of a transfer sheet used is lower than $3\times10^{13}$ Ω-cm as in case of plain paper, broadening of contour or reduction of the transfer efficiency is caused by scattering of developer particles at the transfer step. This disadvantage is moderated to some extent by coating the toner-receiving surface of the transfer sheet with a resin, wax or oil having a high electric resistance. This improvement, however, is reduced under a high-humidity condition. Furthermore, the cost of the transfer sheet is increased by coating with a resin or the like and the feel of the transfer sheet is reduced.

As another type of the one-component magnetic developer, there is known a non-conductive magnetic developer comprising an intimate particulate mixture of a fine powder of a magnetic material and an electroscopic binder. For example, the specification of U.S. Pat. No. 3,645,770 discloses an electrostatic photographic reproduction process in which a magnetic brush (layer) of the above-mentioned non-conductive magnetic developer is charged with a polarity opposite to the polarity of the charge of an electrostatic latent image to be developed by means of corona discharge, the charged developer is brought into contact with a latent image-carrying substrate to develop the latent image and the developer image is transferred onto a transfer sheet. This electrostatic photographic reproduction process is advantageous in that a transfer image can be formed even on plain paper as the transfer sheet. However, this process is still disadvantageous in that it is difficult to uniformly charge the magnetic brush of the non-conductive magnetic developer even to the base portion thereof, it is generally difficult to form an image having a sufficient density and the apparatus becomes complicated because a corona discharge mechanism should be disposed in the developing zone.

Recently, there have been proposed a process in which an electrostatic latent image is developed by frictional charging of a non-conductive magnetic developer by frictional contact of the developer with the surface of a latent image-carrying substrate (see Japanese Patent Application Laid-Open Specification No. 62638/75) and a process in which development is effected by utilizing dielectric polarization of a non-conductive magnetic developer (see Japanese Patent Application Laid-Open Specification No. 133026/76). In the former process, however, if development conditions are not strictly controlled, fogging is readily caused (especially when the degree of the contact of the tip of the spike of magnetic toner particles with the surface of the photosensitive material is high) or fixing or blocking of the magnetic toner particles onto the developing sleeve is caused, and this undesirable phenomenon is especially conspicuous when the copying operation is conducted continuously. In the latter process, there does not arise the problem of fogging, but since a visible image is formed by developing a latent image by utilizing the dielectric polarizing effect induced in the magnetic toner, the low-potential area of the latent image is not effectively developed. Accordingly, in the resulting print, a low-density portion of an original is hardly reproduced and reproduction of a half tone is difficult. Moreover, prints obtained according to these two processes are poor in the image sharpness, and when a p-type photosensitive material such as selenium is used as the photosensitive plate and a positively charged image is developed, it is very difficult to obtain an image having a sufficient density according to any of the foregoing two processes.

Furthermore, the specification of U.S. Pat. No. 4,102,305 discloses a process in which a one-component type magnetic developer, the electric resistance of which changes depending on the intensity of the electric field, namely a one-component type magnetic developer which becomes substantially conductive in a high electric field but has a high electric resistance in a low electric field, is used, a high voltage is applied between a magnetic brush-forming sleeve and a photosensitive plate to effect development under such conditions that the developer particles become conductive and transfer of the developer particles to a transfer sheet is carried out in a low electric field or in an electric field-free state to obtain an excellent transferred image. This specification teaches that the above-mentioned developer having a high electric field dependency of the electric resistance is prepared by spray-granulating 50% by weight of stearate-coated magnetite and 50% by weight of a styrene/n-butyl methacrylate copolymer. This process is excellent in the above idea of obtaining a good transferred image, but this process is disadvantageous in that a peculiar high voltage apparatus is necessary for the development and though the formed image has a high density, the image sharpness is still insufficient.

Moreover, the specification of U.S. Pat. No. 4,121,931 discloses a process in which an electrically insulating one-component type magnetic developer is used, a magnetic brush-forming sleeve is used as an electrode and a voltage is applied between this electrode and a photosensitive plate to cause a turbulent agitation in the developer on the sleeve, whereby the developer particles are uniformly charged. This process, however, is disadvantageous in that a high voltage apparatus should be disposed in the developing zone and special means should be disposed to agitate the developer particles on the sleeve.

SUMMARY OF THE INVENTION

We found that when magnetic toner particles having a high electric resistance are mixed at a specific ratio with a specific magnetic carrier, that is, a magnetic carrier consisting of a non-pulverizing agglomerate of cubic particles of magnetite having a particle size of 1 to 14 microns as measured by an electron microscope and the resulting two-component type magnetic developer is employed, the image density and image quality can prominently be improved over the image density and image quality attainable by the single use of the magnetic toner.

More specifically, in accordance with the present invention, there is provided a two-component type magnetic developer comprising a magnetic carrier consisting of a non-pulverizing agglomerate of cubic particles of magnetite having a particle size of 1 to 14 microns as measured by an electron microscope and a magnetic toner having a high electric resistance and consisting of particles having a particle size of 3 to 30 microns and comprising a binder resin medium and magnetite having a particle size smaller than 1 micron, which is dispersed in the binder resin medium, the magnetic carrier/magnetic toner mixing weight ratio being in the range of from 5/100 to 40/100.

In the two-component type magnetic developer of the present invention, several characteristic features not observed in conventional one-component type and two-component type magnetic developers can be attained by mixing a magnetic toner with a specific magnetic carrier consisting of the above-mentioned agglomerate of particles of magnetite having a relatively small diameter.

In the first place, the developer of the present invention gives a high image density not expected in ordinary one-component type electrically insulating magnetic toners. FIG. 3 of the accompanying drawings illustrates the relation of the amount of agglomerate magnetite added to the magnetic toner having a high electric resistance to the reflection density and fog density of the formed image. From FIG. 3, it is seen that when agglomerate magnetite is incorporated as the magnetic carrier at the above-mentioned weight ratio, the image density is drastically increased over the image density obtained when such agglomerate magnetite is not incorporated and the fog density is rather decreased. When a copied image obtained by using a developer composed solely of the magnetic toner is practically compared with a copied image obtained by using the developer of the present invention, it is seen that the developer of the present invention is advantageous in that the formed image is free of the edge effect. When an electrically insulating toner is mixed with an ordinary magnetic carrier such as iron powder, the toner particles are held on the sleeve by both the electrostatic force and the magnetic force, and the concentration of the toner contributing to the development is reduced, with the result that the density of the formed image is reduced. In contrast, according to the present invention, as pointed out hereinbefore, the image density is prominently improved. It is believed that the reason why the image density and image quality can be improved according to the present invention is that the agglomerate magnetite incorporated as the carrier increases the charge quantity of the magnetic toner and the agglomerate magnetite per se acts as a development electrode.

Furthermore, the two-component type magnetic developer of the present invention is advantageous over ordinary one-component type and two-component type developers in that the property of cleaning the toner left on a photosensitive plate after development and transfer is improved. Since the entire magnetite content in the developer of the present invention is higher than in these ordinary developers and the electrostatic attracting force by frictional charging between the carrier and toner is very large, cleaning of the residual toner left on the photosensitive plate by attracting the residual toner to the magnetic brush can be accomplished effectively at a high efficiency.

Moreover, the two-component type magnetic developer of the present invention has several advantages not observed in conventional two-component type developers. More specifically, an image formed by the developer of the present invention is substantially free of defects observed in images formed by conventional two-component type developers such as so-called brush mark, tailing and white spot. The brush mark means a phenomenon in which by leak of the electrostatic latent image through the magnetic carrier or peeling of the developed toner on the photosensitive material by the carrier, a brush-like white portion is formed on the image. Tailing means a phenomenon in which a tail-like line of the toner is formed in a white portion adjacent to the image area. The white spot means a phenomenon in which the magnetic carrier once transferred to the image area is peeled again to leave a white spot on the image area. In the developer of the present invention, the agglomerate magnetite incorporated as the carrier has a particle size smaller than those of conventional magnetic carriers and the amount incorporated of this magnetic carrier is much smaller than in the conventional two-component type developers, occurrence of the above-mentioned defects such as brush mark, tailing and white spot can be effectively prevented.

Furthermore, since the developer of the present invention comprises specific magnetic carrier and magnetic toner as described above, scattering of the toner is prevented, the interior of a copying machine is not contaminated and the toner chargeability is improved. Accordingly, the developer of the present invention can be applied to a high-speed copying machine or a low-potential photosensitive material, and the developer of the present invention is advantageous in that the developer of the present invention can be applied to a copying machine for a one-component type magnetic developer having a simple structure as it is or after a simple modification has been made.

DETAILED DESCRIPTION OF THE PREFERRED EMBODIMENTS

The present invention will now be described in detail.

[Magnetic Carrier]

Figure 1:
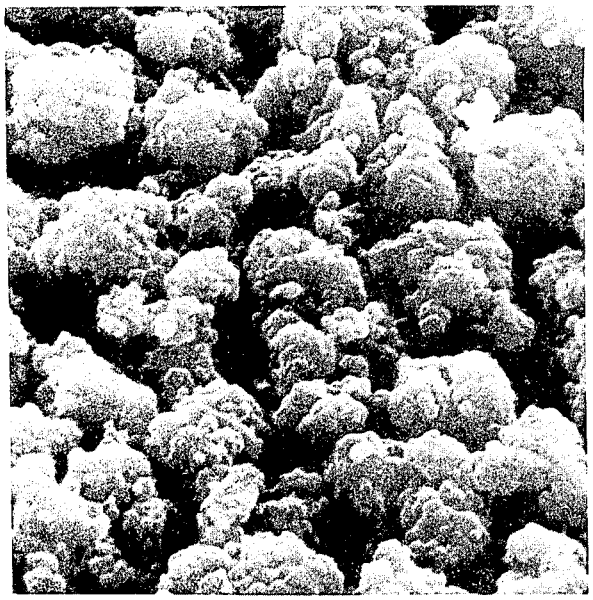
FIG. 1 is an electron microscope photograph of magnetite consisting of a non-pulverizing agglomerate of cubic particles, which is used in the present invention.
Figure 2:
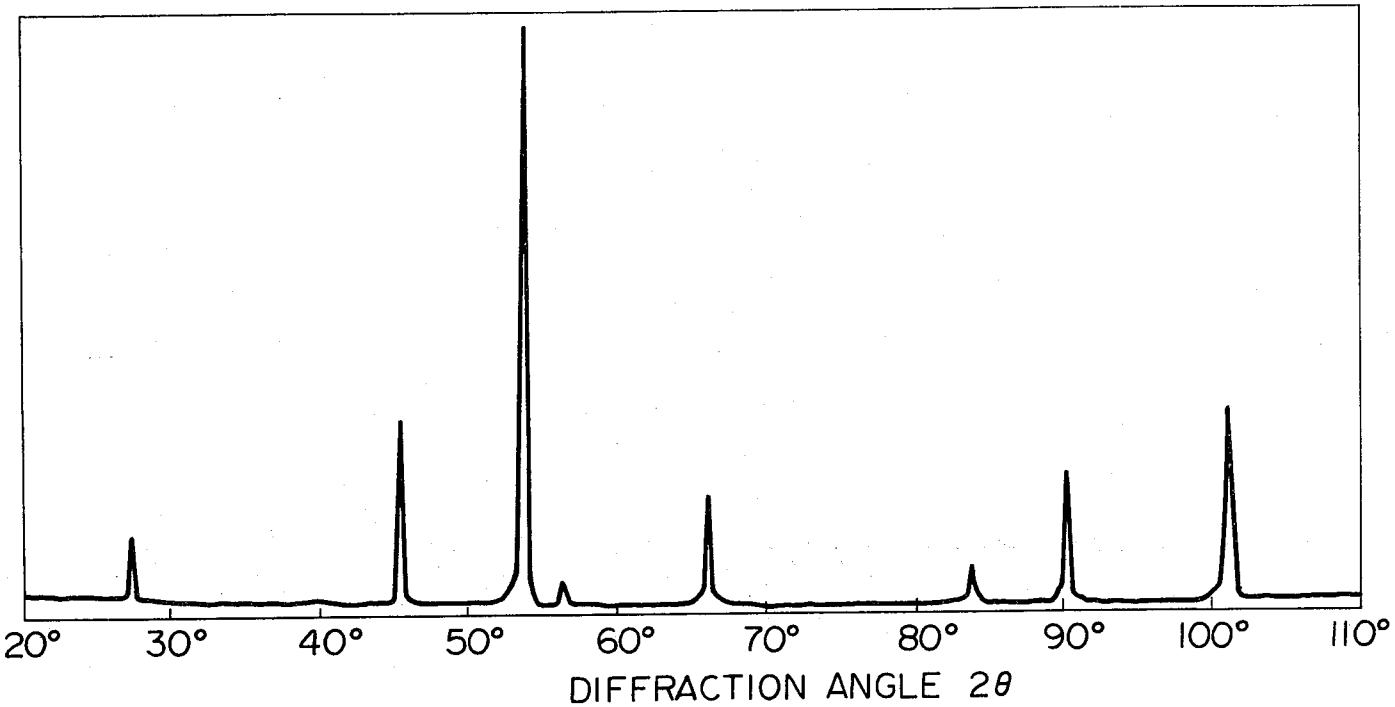
FIG. 2 shows an X-ray diffraction pattern of the agglomerate shown in FIG. 1.

As is seen from the electron microscope photograph of FIG. 1 and the X-ray diffraction pattern of FIG. 2, the powdery magnetic material used as the magnetic carrier in the present invention is magnetite consisting of a non-pulverizing agglomerate of cubic particles.

By the term "non-pulverizing agglomerate" used in the instant specification and appended claims is meant an agglomerate of fine particles which are densely aggregated with one another and in which the particle size distribution is not substantially changed even by an ordinary pulverizing treatment, for example, 5 hours' ball-milling treatment.

This non-pulverizing agglomerate has a number average particle size of 1 to 14 microns, especially 2 to 10 microns, as measured by an electron microscope. Namely, it has a particle size larger than the particle size of ordinary magnetite particles.

Since the agglomerate magnetite used in the present invention has the above-mentioned dense aggregate structure and a relatively coarse particle size, the volume per unit weight, namely the bulk, is smaller than that of particles of magnetite of the cubic or needle crystal form or amorphous magnetite heretofore used for one-component magnetic developers. More specifically, the magnetite has an apparent density of 0.5 to 1.5 g/ml, especially 0.6 to 1.3 g/ml, as measured by the method of JIS (Japanese Industrial Standard) K-5101.

The non-pulverizing agglomerate of cubic particles has magnetic characteristics of a saturation magnetization of 75 to 88 emu/g, a residual magnetization of 8 to 15 emu/g and a coercive force of 40 to 200 Oe.

The non-pulverizing agglomerate used in the present invention is prepared according to the following method, though an applicable method is not limited to this method.

A weakly alkaline aqueous solution, for example, aqueous ammonia, is added to an aqueous solution of iron (III) sulfate to form precipitates of iron (III) hydroxide. The precipitates are subjected to a hydrothermal treatment under pressure while maintaining the pH value of the mother liquor at 3 to 9, whereby gel-like precipitates of iron hydroxide are changed to cubic particles of alpha-$Fe_2O_3$ (hematite). If the weakly alkaline aqueous solution is used to maintain the pH value of the mother liquor to a level close to the acidic side, fine cubic particles which tend to aggregate are formed, and the so-obtained particles are aged by carrying out the hydrothermal treatment at 150° to 230° C. for a long time, for example, more than 50 hours, whereby alpha-diiron trioxide having the configuration specified in the present invention can be obtained. If this alpha-diiron trioxide is reduced under known conditions, for example, by heating it at 400° C. with hydrogen in a reducing furnace, triiron tetroxide ($Fe_3O_4$) having the configuration specified in the present invention can be obtained. The reducing treatment is ordinarily carried out so that the $Fe^{2+}/Fe^{3+}$ atomic ratio is in the range of from 0.9/1.0 to 1.1/1.0. Thus, triiron tetroxide having the above-mentioned specific micro-structure can be obtained. (This method is referred to as "method I" in Examples given hereinafter.)

The X-ray diffraction pattern of the magnetite used in the present invention is the same as that of ordinary magnetite of the cubic crystal form and in view of the height of the diffraction peak, it has been confirmed that the magnetite used in the present invention is not substantially different from ordinary magnetite of the cubic crystal form in the degree of crystallization.

As another method of preparing the agglomerate type magnetite, there can be mentioned a method comprising synthesizing fine cubic $\alpha$-$Fe_2O_3$, spray-granulating this $\alpha$-$Fe_2O_3$ together with a binder to form particles having the above-mentioned particle size, firing the granulation product at 700° to 1000° C. and reducing the fired product according to the above-mentioned method (this method is referred to as "method II" in Examples given hereinafter).

[Magnetic Toner]

A magnetic toner having a high electric resistance, which comprises particles having a particle size of 3 to 30 microns, especially 5 to 25 microns, and being composed of a binder resin medium and magnetite having a particle size smaller than 1 micron, which is dispersed in the binder resin medium, is used as the magnetic toner in the present invention.

As the binder medium, there can be used resins and resinous media which show a fixing property under application of heat or pressure. These binder media may be used singly or in the form of a mixture of two or more of them. It is preferred that the volume resistivity of the binder medium be at least $1\times10^{15}$ Ω-cm as measured in the state where magnetite is not incorporated.

As the binder medium, there are used homopolymers and copolymers of mono- and di-ethylenically unsaturated monomers, especially (a) vinyl aromatic monomers and (b) acrylic monomers.

As the vinyl aromatic monomer, there can be mentioned monomers represented by the following formula:

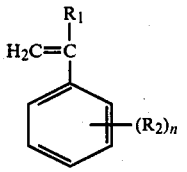

wherein $R_1$ stands for a hydrogen atom, a lower alkyl group (having up to 4 carbon atoms) or a halogen atom, $R_2$ stands for a substituent such as a lower alkyl group or a halogen atom, and n is an integer of up to 2 inclusive of zero, such as styrene, vinyl toluene, alpha-methylstyrene, alpha-chlorostyrene, vinyl xylene and vinyl naphthalene. Among these vinyl aromatic monomers, styrene and vinyl toluene are especially preferred.

As the acrylic monomer, there can be mentioned monomers represented by the following formula:

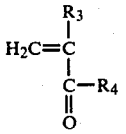

wherein $R_3$ stands for a hydrogen atom or a lower alkyl group, and $R_4$ stands for a hydroxyl group, an alkoxy group, a hydroxyalkoxy group, amino group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-dimethylaminopropyl acrylate and acrylamide.

As another monomer to be used singly or in combination with the above-mentioned monomer (a) or (b), there can be mentioned, for example, conjugate diolefin monomers represented by the following formula:

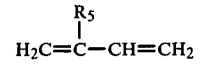

wherein $R_5$ stands for a hydrogen atom, a lower alkyl group or a chlorine atom, such as butadiene, isoprene and chloroprene.

As still another monomer, there can be mentioned ethylenically unsaturated carboxylic acids and esters thereof such as maleic anhydride, fumaric acid, crotonic acid and itaconic acid, vinyl esters such as vinyl acetate, and vinyl pyridine, vinyl pyrrolidone, vinyl ethers, acrylonitrile, vinyl chloride and vinylidene chloride.

It is preferred that the molecular weight of such vinyl type polymer be 3,000 to 300,000, especially 5,000 to 200,000.

The magnetite incorporated in the magnetic toner has a number average particle size less than 1 micron, especially in the range of from 0.1 to 0.7 micron. The shape of particles of the magnetite is not particularly critical. Namely, fine cubic particles as described hereinbefore, amorphous particles, rounded particles and needle-like particles or combinations thereof may be used.

In this magnetic toner, it is preferred that the above-mentioned agglomerate be used in an amount of 35 to 75% by weight, especially 45 to 65% by weight, based on the sum of the amounts of the binder medium and the magnetite.

In preparing the toner, magnetite is uniformly and homogeneously kneaded with the binder medium and the kneaded composition is granulated and, if necessary, sieved, whereby the intended magnetic toner is obtained.

Known auxiliary components for developers may be added according to known recipes prior to the above-mentioned kneading and granulating steps. For example, pigments such as carbon black and dyes such as Acid Violet may be added singly or in combination in amounts of 0.5 to 5% by weight based on the total composition so as to improve the hue of the developer. Furthermore, a filler such as calcium carbonate or powdery silica may be added in an amount of up to 20% by weight based on the total composition to obtain a bulking effect. In the case where fixing is effected by a hot roll, an offset-preventing agent such as a silicone oil, a low-molecular-weight olefin resin or a wax may be used in an amount of 2 to 15% by weight based on the total composition. In the case where fixing is effected by means of a pressure roll, a pressure fixability-improving agent such as paraffin wax, an animal or vegetable wax or a fatty acid amide may be used in an amount of 5 to 30% by weight based on the total composition. Furthermore, in order to prevent cohesion or agglomeration of developer particles and improve the flowability thereof, a flowability-improving agent such as a fine powder of polytetrafluoroethylene or finely divided silica (fumed silica) may be added in an amount of 0.1 to 1.5% by weight based on the total composition.

Shaping of the magnetic toner can be accomplished by cooling the above-mentioned kneaded composition, pulverizing the composition and, if necessary, classifying the pulverization product. Mechanical high-speed stirring may be conducted so as to remove corners of indeterminate-shape particles.

[Developer and Use Thereof]

According to the present invention, the above-mentioned magnetic carrier comprising the agglomerate type magnetite and the above-mentioned high-electric-resistance magnetic toner are used at a weight ratio of from 5/100 to 40/100, especially from 7/100 to 35/100.

When both the components are combined at the above-mentioned weight ratio, the image density is remarkably improved over the image density obtained when the weight ratio is outside the above-mentioned range, and since the amount of the carrier in the developer of the present invention is much smaller than in known two-component type developers, the image quality can be prominently improved.

Mixing of the magnetic carrier and the magnetic toner can be accomplished by the known dry-blending method. For example, if the magnetic toner is supplied to a developer tank in an amount corresponding to the amount of the consumed magnetic toner and is mixed with the magnetic carrier left in the tank, the developer of the present invention is formed in situ.

In the electrostatic photographic reproduction process using the developer according to the present invention, formation of an electrostatic latent image can be performed according to any of the known methods. For example, an electrostatic latent image can be formed by uniformly charging a photoconductive layer formed on a conductive substrate and subjecting the photoconductive layer to imagewise exposure.

A visible image of the developer is formed by bringing a magnetic brush of the above-mentioned two-component type magnetic developer into contact with the electrostatic latent image-carrying surface of the substrate.

Development of the electrostatic latent image with the developer of the present invention can be accomplished, for example, acording to the following procedures. The above-mentioned mentioned two-component type magnetic developer is charged in a developer hopper. A non-magnetic sleeve is rotatably mounted on a lower end opening of the hopper, and a magnet is disposed in the interior of the sleeve so that the magnet turns in a direction opposite to the rotation direction of the sleeve. When the sleeve and magnet are rotated, a brush layer of the magnetic developer is formed on the sleeve, and this brush layer is cut into an appropriate length by a spike-cutting plate. Then, the brush layer of the developer is lightly contacted with a selenium drum which is rotated in the same direction as the rotation direction of the sleeve to develop an electrostatic latent image on the selenium drum with the magnetic developer.

Then, the developer image on the substrate is brought into contact with a transfer sheet, and corona charging is effected from the back surface of the transfer sheet with the same polarity as that of the electrostatic latent image, whereby the developer image is transferred onto the transfer sheet.

In the present invention, fixation of the transferred image may be carried out according to any of a hot roller fixation method, a flash lamp fixation method and a pressure roller fixation method, and an appropriate fixation method is selected according to the kind of the developer.

The developer of the present invention is especially effective for a p-type photosensitive plate on which a positively charged latent image is formed, for example, a selenium photosensitive plate or a photosensitive plate comprising an organic photoconductive material layer. The conventional one-component magnetic developer of the frictional charging type can be applied to a photosensitive plate having a negatively charged latent image, but if this developer is used for developing a positively charged latent image formed on the above-mentioned p-type photosensitive plate, no satisfactory results can be obtained. In contrast, when the developer of the present invention is used, excellent results can be obtained in development and transfer of positively charged latent images.

The present invention will now be described in detail with reference to the following Examples that by no means limit the scope of the invention. All of "parts" and "%" are by weight unless otherwise indicated.

EXAMPLE 1

A mixture of 220 parts of magnetite having a coercive force of 85 Oe, an apparent density of 0.37 g/ml and a particle size of 0.4 to 0.5 micron, 170 parts of a styrene/acrylic copolymer (having a weight average molecular weight of 71,000), 10 parts of an acrylic resin (X-106 manufactured and supplied by Ionac Co.), 2 parts of calcium stearate and 3 parts of a negative charge controlling agent (Bontron S-31 manufactured and supplied by Orient Kagaku Kogyo K.K.) was kneaded and molten by a two-roll mill, and the kneaded mixture was naturally cooled and roughly pulverized to a particle size of 0.5 to 2 mm by a cutting mill. Then, the roughly pulverized mixture was finely pulverized by a jet mill and classified by a zigzag classifying machine to obtain a magnetic toner having a particle size of 5 to 25 microns (50% volume diameter: 10.4 microns). Hydrophobic silica (R-972 manufactured and supplied by Nippon Aerosil K.K.) was added in an amount of 0.3% based on the total weight of the magnetic toner to prepare a magnetic toner.

Incidentally, the coercive force was measured by a magnetic property-measuring device (Model VSMP-1 supplied by Toei Kogyo K.K.; magnetic field=5 KOe), the apparent density was measured according to the method of JIS K-5101, and the particle size was determined from an electron microscope photograph.

The so-prepared magnetic toner (comparative toner) was mixed with 15% by weight of magnetite shown in Table 1, whereby two-component type magnetic developers a', b', c', d' and e' were prepared.

Incidentally, magnetites a and b shown in Table 1 were those having an ordinary cubic crystal form, magnetites c and e were those prepared according to the above-mentioned method I, and magnetite d was one obtained according to the above-mentioned method II.

TABLE 1

| Magnetite | Coercive Force (Oe) | Apparent Density (g/ml) | Particle Size (μ) | Volume Resistivity (Ω · cm) |
|---|---|---|---|---|
| a | 185 | 0.580 | 0.2–0.5 | $7.1 \times 10^7$ |
| b | 63 | 0.410 | 0.4–0.6 | $4.2 \times 10^8$ |
| c | 76 | 0.665 | 0.8–2.7 | $3.1 \times 10^8$ |
| d | 159 | 0.619 | 3–4 | $2.8 \times 10^7$ |
| e | 83 | 1.104 | 5–7 | $5.5 \times 10^8$ |

The following copying test was carried out by using the so-prepared six magnetic toners.

In a copying machine comprising a selenium drum (outer diameter=150 mm) as a photosensitive material, the intensity of a magnetic field on a developing sleeve (outer diameter=33 mm) having a magnet disposed therein through a non-magnetic member was adjusted to about 900 gauss, and the magnetic toner was applied to a developing roller of the so-called two-rotation system capable of rotating the magnet and the sleeve independently, while adjusting the distance between a spike-cutting plate and the sleeve to 0.3 mm. An arrangement was made so that the magnetic toner was supplied to the developing roller zone from a hopper. The distance between the surface of the photosensitive material and the developing roller was adjusted to 0.5 mm. The developing sleeve and photosensitive material were rotated in the same direction, and the magnet was rotated in the opposite direction. Under the foregoing conditions, charging (+6.7 KV), exposure, development, transfer (+6.3 KV), heater roller fixation and fur brush cleaning were performed. The copying speed was so that 30 copies of the A-4 size were obtained per minute. Slick paper having a thickness of 80 microns was used as a transfer sheet. The results of the copying test are shown in Table 2. The image density was measured on a solid black portion by using a commercially available reflective densitometer (supplied by Konishiroku Shashin Kogyo K.K.). A Copia test pattern supplied by Data Quest Co. was used as a copying test chart, and the gradient characteristic and resolving power were determined from a copy thereof. The image sharpness was determined based on the sharpness of a line image area of the obtained copy.

TABLE 2

| Developer | Image Density | Background Density | Sharpness | Resolving Power (line/mm) | Gradient Characteristic (stages) |
|---|---|---|---|---|---|
| comparative toner | 0.93 | 0.12 | fair | 6.3 | 11 |
| a' | 0.83 | 0.09 | bad | 6.3 | 10 |
| b' | 0.80 | 0.09 | bad | 6.3 | 10 |
| c' | 1.10 | 0.10 | good | 7.1 | 11 |
| d' | 1.44 | 0.09 | excellent | 7.1 | 12 |
| e' | 1.34 | 0.10 | excellent | | |

When the two-component type magnetic developer according to the present invention was used, even if the copying speed was as high as 30 copies (A-4 size) per minute, sharp images having a high density and being free of fog were obtained without degradation of the half tone-reproducing property or the resolving power. Furthermore, in the solid black portion, defects observed in case of ordinary two-component type developers, such as edge effect, carrier tailing and white spot, were not observed at all, and the solid black portion had a sheer black color. However, if the particle size of the agglomerate magnetite of the magnetic carrier was smaller than 1 micron, adverse effects were manifested by incorporation of the magnetic carrier.

EXAMPLE 2

Figure 3:
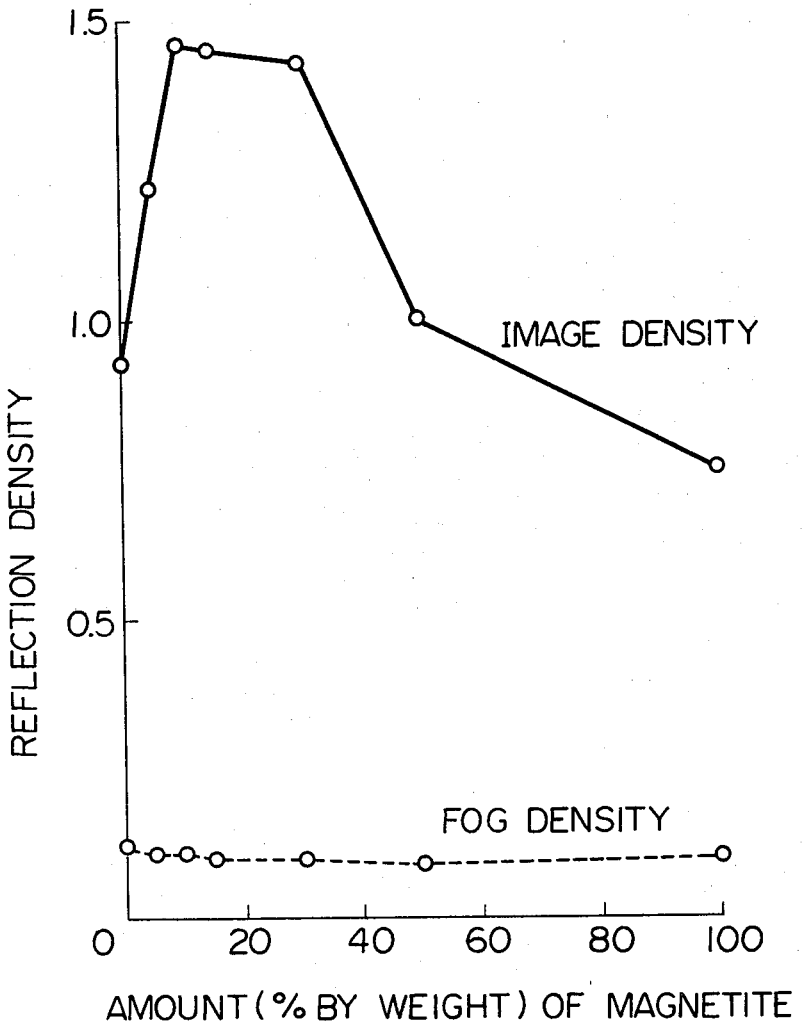
FIG. 3 is a graph illustrating the relation of the amount incorporated of magnetite of the agglomerate type to the reflection density and fog density of the formed image.

The comparative toner prepared in Example 1 was mixed with magnetite (having a coercive force of 67 Oe, an apparent density of 0.810 g/ml and a particle size of 2 to 3.3 microns and prepared according to the method I) at a weight rato of 5, 10, 15, 30, 50 or 100%. The copying test was carried out in the same manner as described in Example 1 by using the so-prepared two-component type magnetic developers. The obtained results are shown in FIG. 3.

When the amount incorporated of the magnetite exceeded 50%, the image density was reduced though the image sharpness was satisfactory, and the contrast was degraded. Therefore, it was confirmed that it is preferred that the amount of magnetite be smaller than 50%, preferably 5 to 40%, especially preferably 7 to 35%. When cleaning was conducted by the development sleeve at the second cycle of development instead of the fur brush cleaning, a satisfactory cleaning effect was obtained. Accordingly, it was confirmed that the development sleeve can be used not only as the developing brush but also as the cleaning brush.

What is claimed is:

1. A two-component type magnetic developer comprising a magnetic carrier consisting of a non-pulverizing agglomerate of cubic particles of magnetite wherein numerous fine particles of magnetite are so densely aggregated with one another that the particle size distribution is not substantially changed even by five hours' ball-milling treatment and an insulating magnetic toner consisting of particles having a particle size of 3 to 30 microns, said toner comprising a binder resin medium and magnetite having a particle size smaller than 1 micron, which is dispersed in the binder resin medium, said agglomerate having substantially the same configuration as that shown in the electron microscope photograph of FIG. 1 of the accompanying drawings, a particle size of 2 to 10 microns as measured by an electron microscope and an apparent density of 0.6 to 1.3 g/ml as measured by the method of JIS (Japanese Industrial Standard) K-5101 and the magnetic carrier/magnetic toner mixing weight ratio is in the range of from 5/100 to 40/100.

2. The two-component type magnetic developer according to claim 1 wherein the non-pulverizing agglomerate of cubic particles of magnetite has a saturation magnetization of 75 to 88 emu/g, a residual magnetization of 8 to 15 emu/g and a coercive force of 40 to 200 Oe.

3. The two-component type magnetic developer according to claim 1 wherein the insulating magnetic toner consists of particles having a particle size of 5 to 25 microns.

4. The two-component type magnetic developer according to claim 1 wherein the mixing weight ratio of the magnetic carrier/magnetc toner is in the range of from 7/100 to 35/100.

* * * * *